US007926908B2

(12) United States Patent
Mizutani

(10) Patent No.: US 7,926,908 B2
(45) Date of Patent: Apr. 19, 2011

(54) INK JET PRINTING APPARATUS AND INK JET PRINTING METHOD

(75) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 12/233,016

(22) Filed: Sep. 18, 2008

(65) Prior Publication Data

US 2009/0079790 A1 Mar. 26, 2009

(30) Foreign Application Priority Data

Sep. 21, 2007 (JP) ..... 2007-245368

(51) Int. Cl.
*B41J 2/21* (2006.01)

(52) U.S. Cl. ..... 347/43; 347/40

(58) Field of Classification Search ..... 347/9, 12, 347/15, 20, 95, 100, 21, 40–43
See application file for complete search history.

(56) References Cited

U.S. PATENT DOCUMENTS

| | | | | |
|---|---|---|---|---|
| 5,903,290 | A * | 5/1999 | Nicoloff et al. | 347/43 |
| 6,123,411 | A * | 9/2000 | Inui et al. | 347/43 |
| 6,439,708 | B1 * | 8/2002 | Kato et al. | 347/98 |
| 6,688,730 | B2 * | 2/2004 | Asaki et al. | 347/64 |
| 6,705,695 | B2 * | 3/2004 | Otsuki | 347/9 |
| 6,964,467 | B2 | 11/2005 | Kaneko et al. | |
| 7,118,193 | B2 | 10/2006 | Kaneko et al. | |

FOREIGN PATENT DOCUMENTS

| | | |
|---|---|---|
| JP | 2001-171119 A | 6/2001 |
| JP | 2004-181698 A | 7/2004 |

* cited by examiner

*Primary Examiner* — Thinh H Nguyen
(74) *Attorney, Agent, or Firm* — Fitzpatrick, Cella, Harper & Scinto

(57) ABSTRACT

There is provided an ink jet printing apparatus and a printing method capable of reducing unevenness due to a time lag. An ink jet printing apparatus comprise a printing head including a first and a second eject port array. The second eject port array is shorter than said first eject port array in said conveying direction of the printing medium. The first eject port array has a first a second. The first eject port group is disposed parallel to said second eject port array. The second eject port group is not disposed parallel to the second eject port array. In an identical printing area of the printing medium, a printing ratio of the first eject port group is lower than that of the second eject port group. The second ink contains a component that reduces dispersion stability of the first ink.

10 Claims, 10 Drawing Sheets

| AREA | TIME DIFFERENCE BETWEEN FIRST APPLICATION (BLACK) AND SECOND APPLICATION (COLOR) | DENSITY |
|---|---|---|
| A C E | LARGE | THICK |
| B D F | SMALL | THIN |

INK JET PRINTING APPARATUS AND INK JET PRINTING METHOD

BACKGROUND OF THE INVENTION

1. Field of the Invention

The present invention relates to an ink jet printing apparatus and an ink jet printing method, particularly to an ink jet printing apparatus and an ink jet printing method ejecting black ink and color ink.

2. Description of the Related Art

In an ink jet type printing apparatus, it is keenly demanded for increasing the printing speed and image quality in color printing using a plain paper or the like. The following techniques are generally known as techniques to increase the printing speed. That is, in addition to increasing the length of a printing head; generally, the printing (drive) frequency of the printing head is increased; and bidirectional printing is carried out. Particularly, compared to one-way printing, the bidirectional printing decentralizes the energy necessary for obtaining the same throughput on the time basis. Therefore, the bidirectional printing is an effective method as a total system for reducing the cost.

However, the bidirectional printing has a problem as described below. That is, depending on the arrangement structure of a printing head, the ejecting order (application order) of color inks differs between a forward direction and a backward direction of the main scanning. This may cause a stripe-like unevenness of colors. As an arrangement for solving such unevenness of color caused by the difference of ink application order, there is known a printing head in which the ink nozzle arrays are symmetrically arranged (for example, Japanese Patent Laid-Open No. 2001-171119).

When printing a text or the like mainly on a plain paper, an ink jet printing apparatus which uses pigment type ink to achieve high quality in black characters becomes a major trend. In many cases, pigment type black ink is prepared as a low permeable composition to prevent deterioration in quality due to feathering. When a printing head with the symmetrically arranged nozzles being disposed parallel to nozzles which eject black ink of low permeation property in a main scanning direction is used, the symmetrically arranged nozzles ejecting a color ink of high permeation property the permeability of which is relatively high, image degradation may be caused. That is, exudation (bleed) or white blur phenomenon (decrease of density due to sinking of ink of low permeation property) may occur in a boundary between black and color. Therefore, in many cases, a printing head, in which a nozzle array ejecting black ink and a nozzle array ejecting color ink are disposed parallel to each other, is employed. To be more precisely, there is used a printing head having a nozzle arrangement in which a nozzle array of black ink is longer than a nozzle array of color ink, and a part of area printed by the nozzle array of black ink overlaps with a area printed by the nozzle array of color ink.

However, when gray is printed using the above-described printing head having a vertical arrangement, unevenness of color may occur. For example, when gray color is printed in a bidirectional printing by mixing dots of black ink and dots of color ink, in each of the scan areas (bands), eject timing of the black ink and the color ink is different from each other in a right end portion and a left end portion of the respective scan areas. That is, in scanning of the printing head, the scan areas corresponding to the nozzles ejecting black ink and the nozzles ejecting color ink are different from each other. Therefore, in a predetermined scan area, the nozzles ejecting black ink perform a former scan (first scan) and the nozzles ejecting color ink perform a latter scan (second scan). Alternatively, the nozzles ejecting color ink perform the first scan and the nozzles ejecting black ink perform the latter second scan. Therefore, the tone of the same gray may differ from each other in the end portions of the two scan areas. As a result, a stripe-like unevenness of color may be generated in the bands on the entire printing medium.

FIGS. 10A and 10B illustrate density differences which occur in a specific area when the printing is carried out using a printing head having a vertical arrangement. Referring to FIG. 10A, in a first main scanning (first forward scan), in the uppermost band (first area), printing is carried out only in an area of black ink nozzle array which is located not in adjacent to the color ink nozzle array. After completing the first main scanning, the sheet is fed by a distance equivalent to one band width. Subsequently, the second main scanning, which is the scanning in the backward direction, is carried out. In the second main scanning (second backward scan), the printing with color ink is carried out corresponding to the color ink nozzle array in the uppermost band (first area) where the black ink has been ejected. Further, in the next band (second area), printing with black ink is carried out corresponding to an area of the black ink nozzle array which is located not adjacent to the color ink nozzle array. In this case, an end area B in the uppermost band (first area) is an area where the ink of respective colors is ejected before and after the scanning direction of a print head is switched. On the other hand, in an end area "A", the ink of respective colors is ejected with a time lag equivalent to one reciprocation movement.

When such bidirectional printing is repeated, particularly in areas adjacent to the ends of the respective bands, applied times of the black ink and the color ink are largely different from each other. In FIG. 10A, end areas A, C and E in the respective bands are the areas where a difference between the applied times of the black ink and the color ink becomes maximum. On the other hand, end areas B, D and F are the areas where the time difference becomes minimum. In the end areas other than the above also, the black ink and the color ink are applied with a time difference corresponding to the respective positions.

Therefore, when the printing is carried out using, for example, black ink of low permeation property and color ink of high permeation property, in the other end of a printing medium, there may be such a case that the color ink is applied before the black ink is applied and permeates into a printing medium. Therefore, the black ink is pressed into the printing medium resulting in a reduction of the density. That is, even when the printing is carried out using the same application amount and in the same application order, in the right end portions and the left end portions of the printing medium, density difference may occur due to the ejecting time difference of the ink.

That is, in the areas A, C and E where the ejecting time between the black ink and the color ink is a longer time, the color ink is applied in a state that the black ink is fixed to some extent as shown in FIG. 10B. Therefore, high density gray is printed. On the other hand, in the areas B, D and F, the ejecting time between the black ink and the color ink is a shorter time as shown in FIG. 10B. Thus, depending on the ejected time difference between the black ink and the color ink, a density difference as "dark" or "light" is repeated alternately in the unit of band width, particularly in the end areas of the bands.

The magnitude of density difference due to the time difference in one band changes stepwise in a scanning direction of the printing head. Therefore, the density difference is hardly recognized visually. However, in the case of density difference which occurs continuously over several bands, in the right and left end areas, the density difference due to the difference of printing time is alternately generated. Therefore, the density differences among bands become conspicuous, resulting in deterioration of image quality.

As a technique to prevent such image degradation due to density difference, there is known a technique in which when the density difference occurs due to the printing time difference, a certain period of waiting time is provided between the printing with the color ink and the printing with the black ink (for example, Japanese Patent Laid-Open No. 2004-181698). According to the above technique, the waiting time allows the previously ejected ink to permeate into a printing medium before the next ink is ejected. The density difference due to printing time difference is reduced and the image degradation can be suppressed.

However, according to the above technique, when the printing, in which the printing time lag causes the density difference, is carried out, the printing is restricted and waited until the ink permeates into the printing medium. As a result, the printing speed is reduced.

SUMMARY OF THE INVENTION

The present invention has been proposed in view of the above problems. An object of the present invention is to provide an ink jet printing apparatus and an ink jet printing method with high printing speed capable of reducing unevenness due to printing time difference, even when performing printing using a printing head that has vertically arranged black and color ink eject port arrays.

In order to achieve the above object, the present invention provides an ink jet printing apparatus comprising a printing head including: a first eject port array having a plurality of eject ports for ejecting first ink, arranged in a conveying direction of printing medium; and a second eject port array having a plurality of eject ports for ejecting second ink, arranged in a conveying direction of printing medium, and being shorter than said first eject port array in said conveying direction of the printing medium; said ink jet printing apparatus causing the printing head to scan bi-directionally in a direction crossing said conveying direction of the printing medium to perform printing, and said first eject port array having a first eject port group and a second eject port group; wherein said first eject port group is disposed parallel to said second eject port array in said main scanning direction; and said second eject port group is not disposed parallel to said second eject port array in said main scanning direction, and wherein: in an identical printing area of said printing medium, a printing ratio of the first eject port group is lower than that of the second eject port group; and said second ink contains a component that reduces dispersion stability of said first ink.

With the above-described arrangement, even when black and color are mixed in an identical area, the color ink can be printed after the black ink has permeated. As a result, by increasing the printing density of the black ink, unevenness due to the time difference can be suppressed even in the bidirectional printing.

Further features of the present invention will become apparent from the following description of exemplary embodiments (with reference to the attached drawings).

DESCRIPTION OF THE EMBODIMENTS

Figure 1:
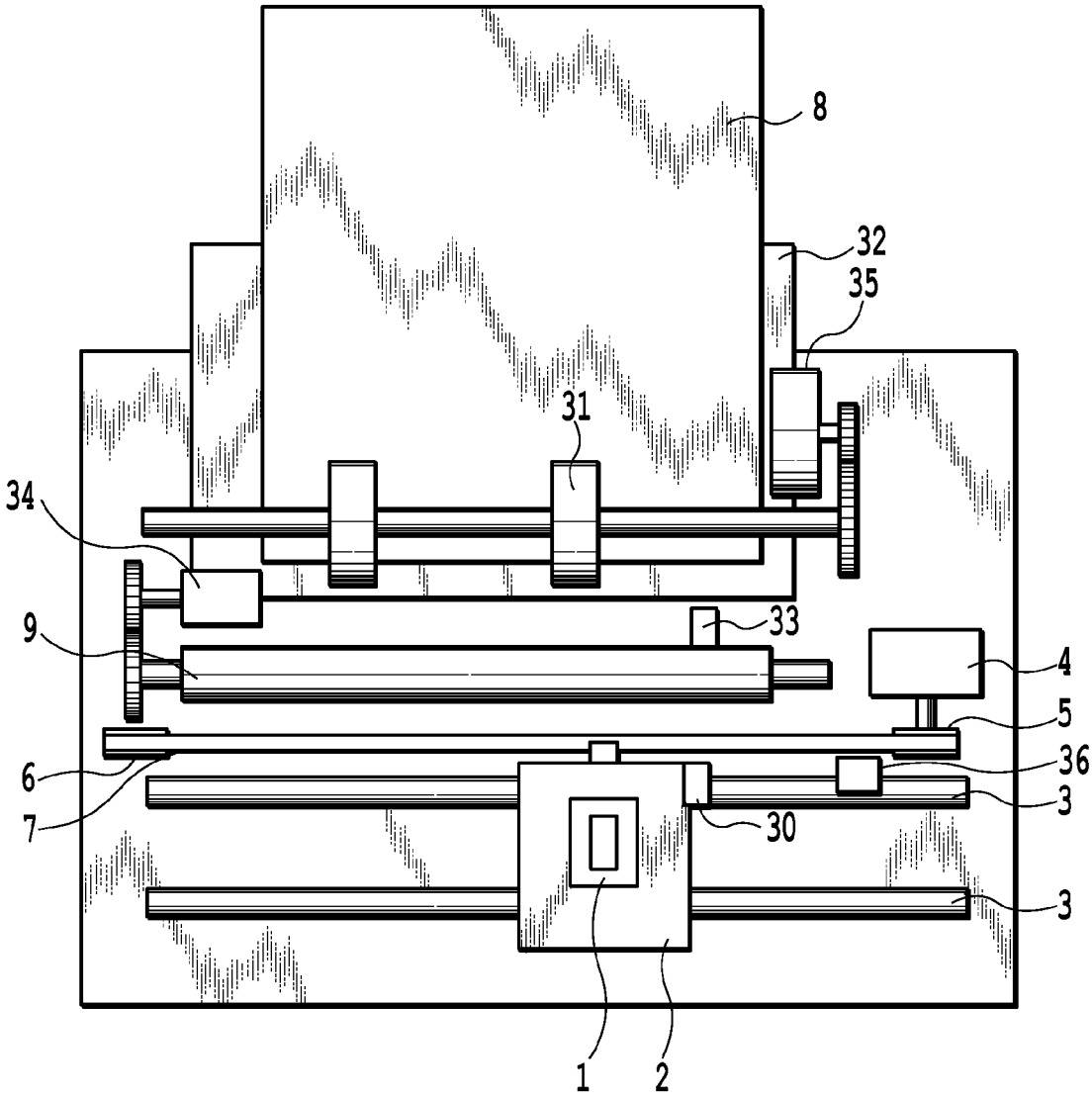
FIG. 1 is a schematic view illustrating an essential portion of an ink jet printing apparatus according to a first embodiment of the present invention.

Referring to the drawings, embodiments according to the present invention will be described below in detail.

First Embodiment

FIG. 1 is a schematic view illustrating an essential portion of an ink jet printing apparatus according to this embodiment. In FIG. 1, a cartridge 1 is mounted in a replaceable manner on a carriage 2. The cartridge 1 includes a print head section and an ink tank section, and the cartridge 1 is provided with a connector (not shown) through which signals for driving the head section are exchanged.

The cartridges 1 are mounted on the carriage 2 being positioned in place thereon. The carriage 2 is provided with a connector holder (electrical connecting section) for transmitting a driving signal and the like to each of the cartridges 1 through the connector. The carriage 2 is supported by a guide shaft 3 capable of reciprocating along the guide shaft 3 that is provided to the apparatus body extending along a main scanning direction. The carriage 2 is driven by a main scanning motor 4 via a drive mechanism such as a motor pulley 5, a driven pulley 6, and a timing belt 7. The position and movement of the carriage 2 is controlled by the drive mechanism. Further, the carriage 2 is provided with a home position sensor 30. With this arrangement, the position of the carriage 2 can be detected when the home position sensor 30 on the carriage 2 passes over the shield plate 36.

When a pick up roller 31 is driven to rotate by a paper convey motor 35 via gears, a print medium 8 such as a printing paper or a plastic thin plate is separated and fed out one by one from an auto sheet conveyer (ASF) 32. The print medium 8 is further fed out (sub-scanning) due to a rotation of a conveying roller 9 through a position (printing section) which is opposed to an eject port face of the cartridge 1. An LF motor 34 drives the conveying roller 9 to rotate via gears. At a point when the print medium 8 passes over a paper end sensor 33, determination whether the paper is fed out and detection of the front end of the paper position are made. The paper end sensor 33 is also used for detecting the actual position of the rear end of printing medium 8 to finally determine the present printing position based on the actual rear end thereof.

The printing medium 8 is supported by a platen (not shown) at the rear side thereof so that a flat printing face is formed in the printing section. Each of the cartridges 1 mounted on the carriage 2 is held so that the eject port face thereof protrudes downward from the carriage 2 to be parallel with the print medium 8 between the two pairs of conveying rollers.

The cartridge 1 is an ink jet head cartridge that ejects ink utilizing, for example, thermal energy. The cartridge 1 is provided with an electrothermal converter for generating thermal energy. That is, the printing head of the cartridge 1 ejects the ink via eject ports utilizing a pressure of bubbles, which are formed by film boiling caused by the thermal energy applied by the electrothermal converter, to thereby perform the printing. The printing head may employ another system in which the ink is ejected by piezoelectric elements.

Figure 2:
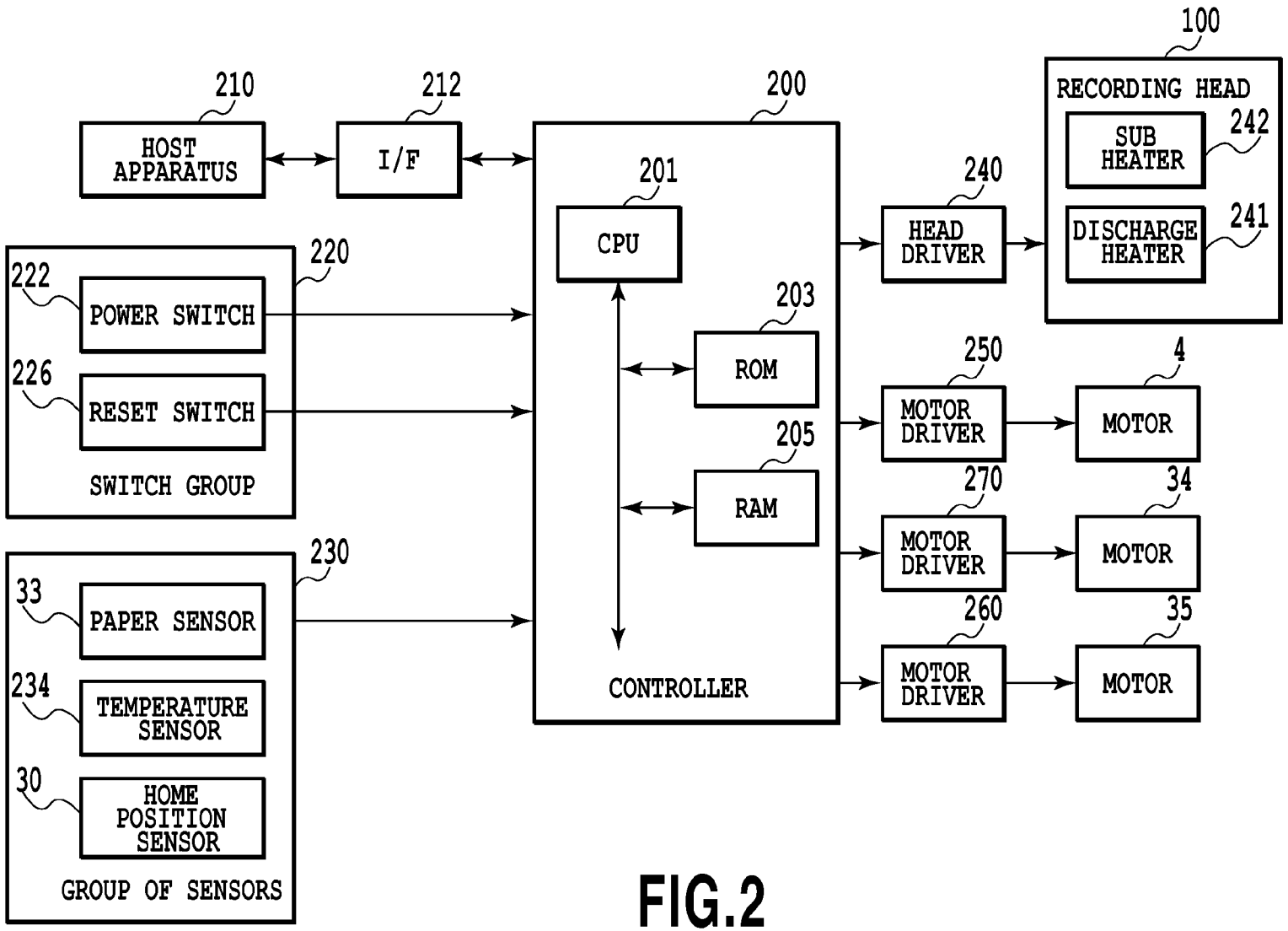
FIG. 2 is a block diagram schematically illustrating a configuration of a control circuit in the ink jet printing apparatus according to the first embodiment of the present invention.

FIG. 2 is a block diagram schematically showing the configuration of a control circuit in the ink jet printing apparatus. Referring to FIG. 2, a controller 200 is a main control section including, for example, a microcomputer type CPU 201, a ROM 203 that stores fixed data such as programs, and necessary tables, and a RAM 205 provided with an image data developing region, a working region and the like. A host apparatus 210 is an image data source (which may be a computer for creating and processing data such as images to be printed, or may be a reader section for reading images only). The host apparatus 210 exchanges image data, commands, status signals and the like with the controller 200 via an interface (I/F) 212.

A group of switches 220 is a group of switches of receiving instructions given by an operator. The group of switches 220 includes a power switch 222, a reset switch 226 for giving a suction recovery instruction, etc. A group of sensors 230 is a group of sensors for detecting status of the apparatus. The group of sensors 230 includes the home position sensor 30, a paper end sensor 33 for detecting existence of a print medium, a temperature sensor 234 for detecting ambient temperature disposed at an appropriate position.

A head driver 240 is a driver that drives an eject heater 241 on the printing head 100 in accordance with print data or the like. The head driver 240 includes a shift register that aligns the printing data corresponding to the position of the eject heater 241, a latch circuit that latches data at an appropriate timing, and a logical circuit element that activates the eject heater synchronously with a drive-timing signal. Further, the head driver 240 includes a timing setting section that appropriately sets drive timing (eject timing) for aligning dot-forming position etc.

The printing head 100 is provided with a sub heater 242. The sub heater 242 controls the temperature to stabilize the ink eject characteristics. The sub heater 242 maybe formed on a printing head substrate along with the eject heater 241, or may be mounted on the printing head body or the cartridge.

A motor driver 250 is a driver that drives the main scanning motor 4. A sub scanning motor 34 is driven by a motor driver 270 to convey the printing medium 8 (sub-scanning).

The paper convey motor 35 is a motor that is driven by a motor driver 260 to separate and convey the printing medium 8 from the ASF.

Figure 3:
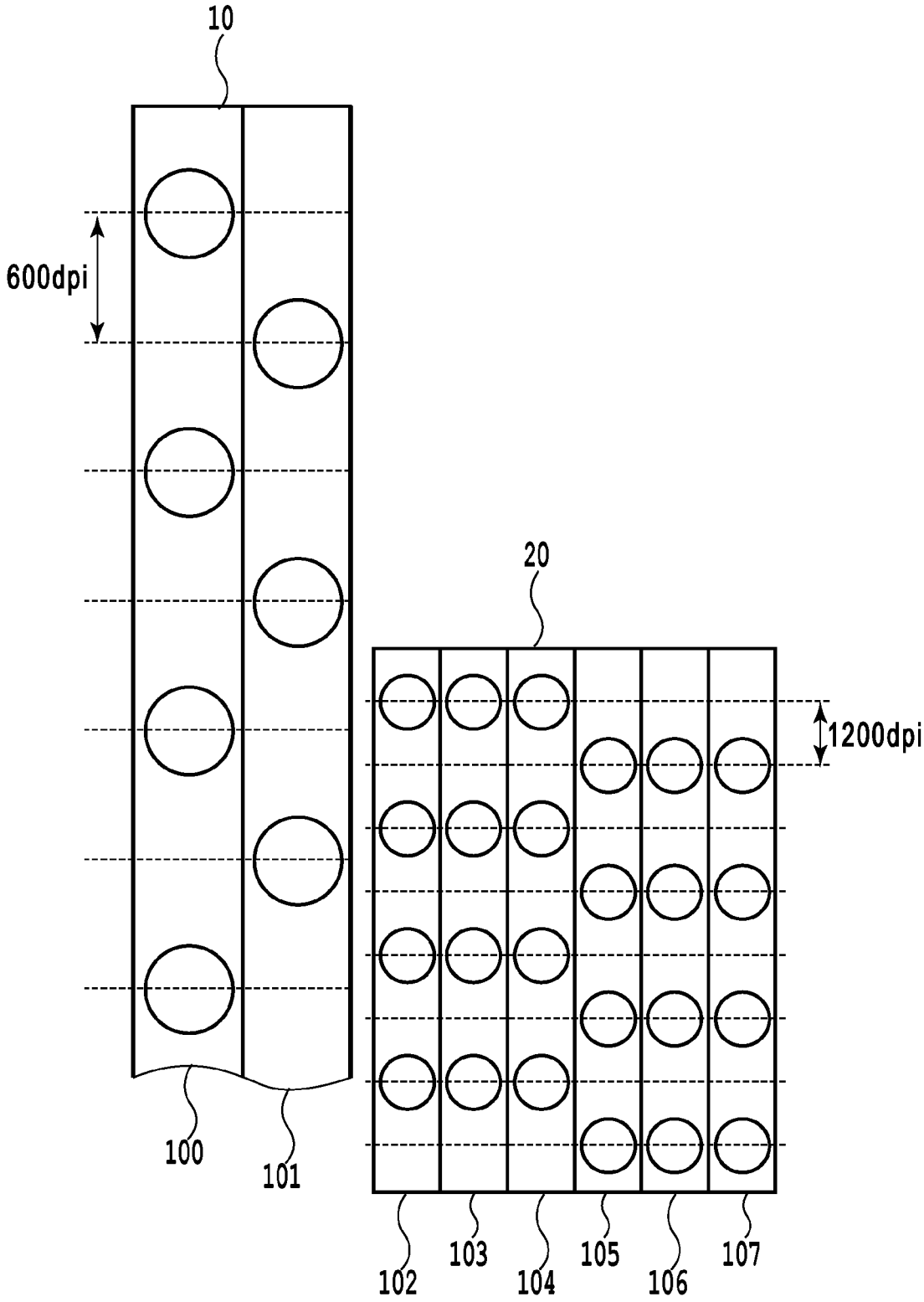
FIG. 3 is a schematic view illustrating a part of the structure of an eject portion in the printing head according to the first embodiment of the present invention.

FIG. 3 is a schematic view partially illustrating the structure of an eject portion of the printing head 100.

Referring to FIG. 3, a plurality of nozzle arrays is formed in a direction crossing the main scanning direction of the printing head 100. That is, the nozzle arrays are formed along a conveying direction of the printing medium.

A black tip 10 on the printing head 100 includes eject port arrays 100 and 101 (first eject port array). The eject port arrays 100 and 101 are provided with nozzles, in which 160 nozzles are disposed at a pitch of 300 dpi to eject black ink as first ink. The nozzles in the eject port arrays 100 and 101 are offset by 600 dpi. Therefore, in view of black color, the nozzles constitute a printing head including 320 nozzles of 600 dpi.

A color tip 20 on the printing head 100 includes eject port arrays (second eject port arrays) that eject color ink as second ink. The printing head according to the present embodiment ejects the ink of plural colors. In the second eject port arrays, plural eject port arrays each of which ejects same color ink are arranged symmetrically with respect to a scanning direction of the printing head. The color tip 20 is formed with a first eject port array 102 that ejects cyan ink, a first eject port array 103 that ejects magenta ink and a first eject port array 104 that ejects yellow ink. Further, the color tip 20 is formed with a second eject port array 105 that ejects yellow ink, a second eject port array 106 that ejects magenta ink and a second eject port array 107 that ejects cyan ink so that the color of each ink is disposed right-left symmetrically. In each array of the eject port arrays, 128 nozzles are formed at a pitch of 600 dpi. The nozzles in the first eject port arrays 102 to 104 and the second eject port arrays 105 to 107 are offset by 600 dpi. Therefore, in view of colors, the printing head includes 256 nozzles of 1200 dpi.

The respective eject port arrays on the printing head are arranged in a direction substantially vertical with respect to the main scanning direction. To be more precisely, the respective eject port arrays on the printing head may be arranged to be slightly inclined in the main scanning direction taking the eject timing into consideration. In the printing head according to the embodiment, the eject port array ejecting the black ink has a total pitch longer than that of eject port array ejecting the color ink. With this arrangement, in a monochrome data area, the printing is carried out using the full width including 320 nozzles on the printing head ejecting the black ink; thereby the speed of printing can be increased.

The ink used in the embodiment will be described below.

According the embodiment, a reactive color ink contains at least one of dye of a component that reduces the dispersion stability of the pigment included in the black ink, and an additive of a component that reduces the dispersion stability of the pigment included in the black ink when mixed with the black ink. The black ink includes salt.

Here, the wording "reduction of the dispersion stability of the pigment contained in the black ink" means that, to be more specifically, agglutination or precipitation of the pigment, thickening of the black ink or the like. The wording "thickening" means a state that the ink including both of the black ink and the color ink mixed with each other has a higher viscosity than that of the ink including any one of them.

The reactivity of the black ink and the color ink will be described below.

It is preferred that the composition of the black ink and the color ink used in the embodiment is prepared so that, when the black ink and the color ink are mixed with each other, the dispersion stability of the pigment contained in the black ink is reduced. To be more precisely, the following two modes are possible; for example:

(1) A mode in which, when the color ink and black ink are mixed with each other, a dye that reduces the dispersion stability of the pigment contained in the black ink is contained; and (2) A mode in which, when the color ink is mixed with the black ink, an additive that reduces the dispersion stability of the pigment contained in the black ink is included.

To be more precisely about the above mode (1), for example, the following examples of (a) and (b) are possible.

(a) An example of preparation in which the pigment contained in the black ink includes anionic group and the dye of the color ink includes cationic group.

In this example, when the color ink and the black ink are mixed with each other, the cationic group of the dye contained in the color ink reacts with the anionic group of the pigment contained in the black ink, and the pigment contained in the black ink is broken and dispersed causing the pigment to aggregate; and thus the ink becomes thicker.

(b) An example of preparation in which the pigment contained in the black ink includes cationic group and the colorant contained in the color ink includes anionic group.

In this example, when the color ink and the black ink are mixed with each other, the anionic group of the colorant contained in the color ink reacts with the cationic group of the pigment contained in the black ink. As a result, the pigment contained in the black ink is dispersed and broken causing the pigment to aggregate; and thus the ink becomes thicker.

To be more precisely about the above mode (2), for example, the following examples of (c) to (e) are available.

(c) The pigment contained in the black ink includes anionic group; and the color ink is polymetal salt composed of polymetal cations. An example of preparation in which at least one polymetal salt composed of polymetal cations selected from, for example, $Mg^{2+}$, $Ca^{2+}$, $Cu^{2+}$, $Co^{2+}$, $Ni^{2+}$, $Fe^{2+}$, $La^{3+}$, $Nd^{3+}$, $Y^{3+}$ and $Al^{3+}$.

In this example, when the color ink and the black ink are mixed with each other, the polymetal cations of the polymetal salt contained in the color ink react with the anionic group of the pigment contained in the black ink. As a result, the pigment contained in the black ink is dispersed and broken causing the pigment to aggregate and the ink to be thicker. The polymetal salt is preferably included in the color ink by, for example, approximately 0.1 to 15% by mass with respect to the total mass of the color ink.

(d) An example of preparation in which the pigment contained in the black ink is stably dispersed at pH 3 to 7, and the color ink is controlled to pH 8 to 11.

In this example, when the color ink and the black ink are mixed with each other, the pH of the black ink is increased, thereby the dispersion stability of the pigment is broken causing the pigment to aggregate and the ink to be thicker.

(e) An example of preparation in which the pigment contained in the black ink is dispersed stably at pH 7 to 11 and the color ink is controlled to pH 3 to 6.

In this example, when the color ink and the black ink are mixed with each other, the pH of the black ink is reduced and the dispersion stability of the pigment is broken causing the pigment to aggregate and the ink to be thicker.

In this embodiment, any one of the three kinds of color ink (for example, cyan ink only), which are ejected from the printing head sections 102 to 107, may be mixed of reactive color ink. Also, all of the three kinds of color ink may be reactive color ink.

Now, the black ink used in the embodiment will be described in detail.

As the pigment contained in the black ink, for example, carbon black is preferably used. As the mode of dispersion of the carbon black contained in the ink, a self-dispersion type or disperse by a dispersant may be employed.

The self-dispersion type carbon black is described below. As the self-dispersion type carbon black, for example, a carbon black, in which at least one hydrophilic radical (anionic group or cationic group) is combined with the surface of the carbon black as an ionic group directly or via other atoms, is exemplified. By using the self-dispersion type carbon black, dispersant, which is added for dispersing the carbon black, can be reduced or eliminated.

In the case of the carbon black the surface of which is combined with the anionic group directly or via another atom group, as an example of hydrophilic radical combined with the surface, for example, —COO(M2), —$SO_3$(M2), —$PO_3$H (M2), —$PO_3(M2)_2$ and the like are exemplified. In the above formulas, "M2" represents a hydrogen atom, alkali metal, ammonium or organic ammonium.

Further, as the pigment for black ink, not a self-dispersion type but an ordinarily carbon black may be used. Fine particles of magnetic material such as magnetite and ferrite, titanium black or the like maybe used as a black pigment. When such ordinary carbon black is used as the pigment for the black ink, a dispersant is preferably added to the ink to be stably dispersed in the hydraulic medium.

There may be preferably used for the dispersant, for example, a compound which has an ionic group to facilitate the carbon black to disperse stably in a water base medium. The example of such a compound includes, for example, styrene-acrylic acid copolymer, styrene-acrylic acid-acrylic acid alkyl ester copolymer, styrene-maleic acid copolymer, styrene-maleic acid-acrylic acid alkyl ester copolymer, styrene-methacrylic acid copolymer, styrene-methacrylic acid-acrylic acid alkyl ester copolymer, styrene-maleic acid half ester copolymer, vinyl naphthalene-acrylic acid copolymer, vinyl naphthalene-maleic acid copolymer, and styrene-maleic anhydride-maleci acid half ester copolymer, or their salts. The compound has preferably a mass-average molecular weight of 1,000-30,000, more preferably 3,000-15,000.

There may be preferably used for the salt in the black ink according to the this embodiment at least one selected from $(M1)_2SO_4$, $CH_3COO(M1)$, Ph—COO(M1), $(M1)NO_3$, (M1)Cl, (M1)Br, (M1)I, $(M1)_2SO_3$, and $(M1)_2CO_3$, wherein M1 is an alkali metal, an inorganic ammonium, or an organic ammonium, and Ph are a phenyl group.

The example of the alkali metal includes Li, Na, K, Rb, and Cs. The example of the organic ammonium includes methyl ammonium, dimethyl ammonium, trimethyl ammonium, ethyl ammonium, diethyl ammonium, triethyl ammonium, monomethanol ammonium, dimethanol ammonium, trimethanol ammonium, ethanol ammonium, diethanol ammonium, and triethanol ammonium.

When the black ink according to the embodiment is used for the ink jet printing, the ink has to have characteristics capable of being ejected from the printing head. From the view of the performance of being ejected from the printing head, as for the characteristics of the liquid, for example, the viscosity is controlled to be 1 to 15 mPa·s; the surface tension is controlled to be 25 mN/m or more; particularly, the viscosity is preferably controlled to be 1 to 5 mPa·s and the surface tension is preferably controlled to be 25 to 50 mN/m.

Figure 4:
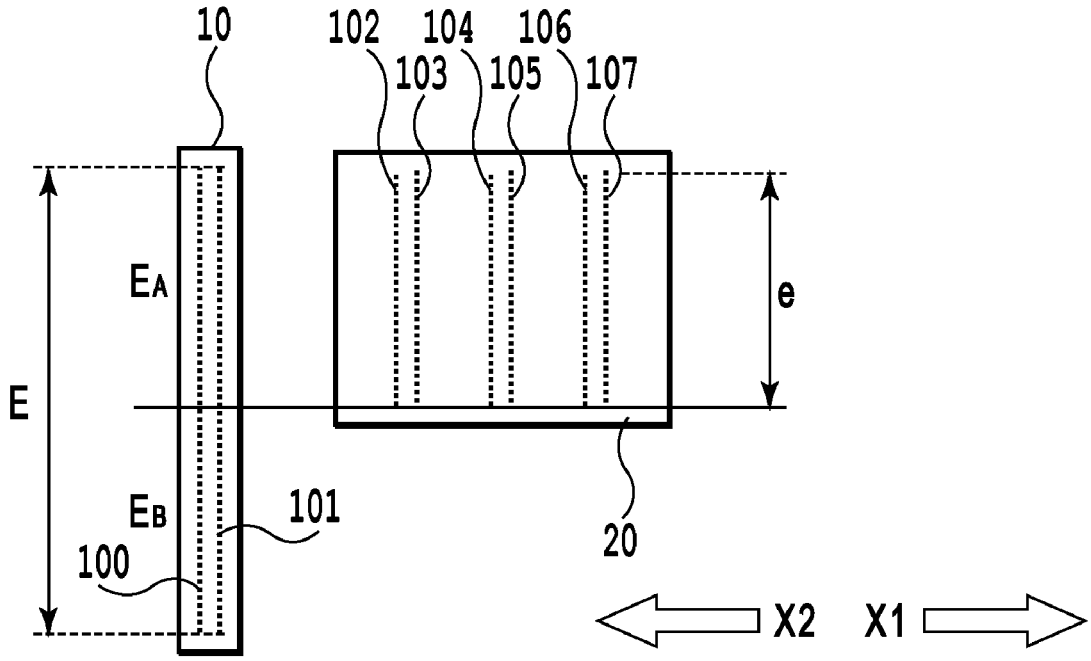
FIG. 4 is a schematic view of a black tip and a color tip according to the first embodiment of the present invention.

FIG. 4 is a schematic view of a black tip 10 and a color tip 20 according to the embodiment. The width of the nozzle group in a usable maximum area (maximum eject port area) in each of ink eject port arrays 100 and 101, which are formed in the black tip 10, is defined as "E". The width of a nozzle group in a usable maximum area (maximum eject port area) in the ink eject port arrays 102 to 107 on the color tip 20 is defined as "e". Further, in the same main scanning, the maximum width of the eject port area capable of printing in the identical printing area of a printing medium by the black tip 10 and the color tip 20 is defined as "e". The relationship between "E" and "e" is E=e×2. The eject port area of the black ink eject port array is separated into two sections; i.e., a first nozzle group "EA" and a second nozzle group "EB" of the eject port area. Each of the separated eject port areas "EA" and "EB" and the maximum eject port area "E" is selectively specified in the printing scan to be described below.

In view of image quality, it is preferred that the black printing ratio of the second nozzle group is larger than the printing ratio of the first nozzle group as described below. More preferably, the printing ratio "X" of the second nozzle group is within a range of 50%<X<80%.

According to the printing method of the embodiment, when printing a color image, the color ink (reactive color ink), which is reactive with the black ink, is used so as to mix with the black ink.

Figure 5:
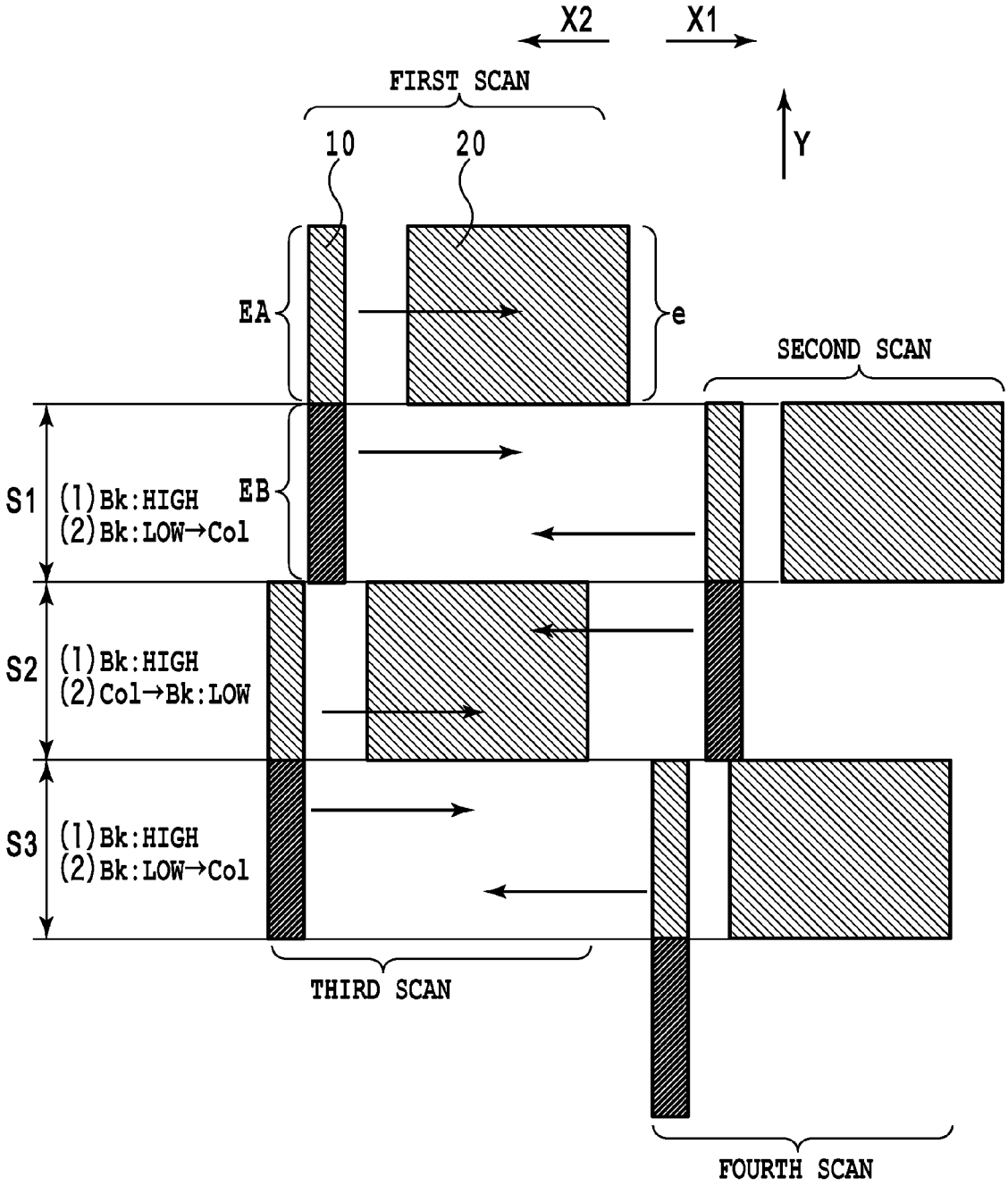
FIG. 5 illustrates printing operation according to the first embodiment of the present invention.

FIG. 5 illustrates the printing operation according to the embodiment.

According to the embodiment, the printing operation is carried out by two or more scanning on the identical printing area to form an image. First of all, a first main scanning (forward scan) of the printing head is carried out in an X1 direction to print a printing area S1. At this time, only the black eject port area "EB" (second nozzle group) is used for printing with the black ink and the eject port area EA (first nozzle group) is not used. The printing ratio of the eject port area "EB" is larger than that of the eject port area "EA". To be more precisely, the printing is carried out with the printing ratio in a range of 50%<X<80%. For example, according to the embodiment, it is assumed that the printing ratio of the second nozzle group is 75%, and the printing ratio of the first nozzle group is 25%.

With this operation, in the printing position of the printing area S1 illustrated in FIG. 5, the printing is carried out with the black ink only first. When the first scan of the printing head (forward scan) is completed, the printing medium is fed by an amount equivalent to E/2 width of the eject port area in a sub-scanning direction (Y-direction).

Subsequently, the printing head carries out a second main scanning (backward scan) in an X2 direction as shown in FIG. 5 to print the printing areas S1 and S2. At this time, in the printing area S2, the printing is carried out using the black eject port area "EB" only. Also, in the printing area S1, the black eject port area "EA" is used to print with the black ink and the eject port area "e" is used to print with the color ink. When the second scan (backward scan) by the printing head is completed, the printing medium is fed by an amount equivalent to the width of the color eject port area "e" in a sub-scanning direction (Y-direction).

Subsequently, the printing head carries out the third main scanning (forward scan) in the X1 direction to thereby print the printing areas S2 and S3. At this time, in a printing area S3, the printing is carried out using the black eject port area "EB" only. In the printing area S2, the printing is carried out using the black eject port area "EA" with the black ink, and the eject port area "e" is used to print with the color ink. When the third scan (forward scan) by the printing head is completed, the printing medium is fed by an amount equivalent to the width of the color eject port area "e" in the sub-scanning direction (Y-direction).

As described above, in the printing system according to the embodiment, the scan with black ink is carried out twice and the scan with the color ink is carried out once to form an image. Further, the application of the black ink is always carried out prior to the application of the color ink.

As described above, according to the embodiment, the printing ratio of the eject port area "EB" which is disposed not parallel to the color ink eject port area "e" is set to 50%<X<80%. As a result, the printing ratio using the black eject port area "EA" where is overlapped with the color eject port area "e" is reduced. Therefore, even when the bidirectional printing is carried out, the unevenness of color, which is caused by the difference of the printing order of the black ink and the color ink between the forward scan and the backward scan, is reduced because the amount of the black ink ejected by the eject port area "EB" is small. That is, even in an area which is printed by the eject port area "e" after being printed by the eject port area "EB" including a small time difference, the color ink is ejected after the black ink has permeated into the printing medium. Also, in the area where the color ink eject port area "e" and the black ink eject port area "EA" are disposed parallel, the color ink is reactive ink that reacts with the black ink. When the printing ratio according to the embodiment is 20%<X<50%, little unevenness of color occurs.

As described above, in the above-described printing method, the difference of the density (unevenness of color) hardly appears in the both end areas in the main scanning direction of the band. That is, after printing with the black ink is carried at a high printing ratio first, and after the black ink has permeated into the printing medium, the printing with the color ink is carried out. Thereby, the unevenness of color caused from the application order of the ink can be reduced.

In the embodiment, the printing ratio of the eject port area "EA" and the eject port area "EB" is set to 20%<X<50% and 50%<X<80%, respectively. However, the printing ratio of the present invention is not limited to the above. That is, the printing ratio of the black ink nozzle group, which performs printing an area with the color ink and the black ink with the same scan, has only to be smaller than the printing ratio of the black ink nozzle group that does not perform the printing with the color ink and the black ink in the same scan.

In the embodiment, although reactive ink is used, the present invention is not limited to such ink. That is, the printing medium may contain above-described polymetal cation.

Second Embodiment

In the first embodiment, defining the width in the maximum eject port area of the black ink as "E", and the width in the maximum eject port area of the color ink as "e", the relationship between "E" and "e" is E=e×2 as illustrated in FIG. 4. However, the present invention is not limited to the above relationship. The width of "E" has only to be at least larger than the width of "e".

Figure 6:
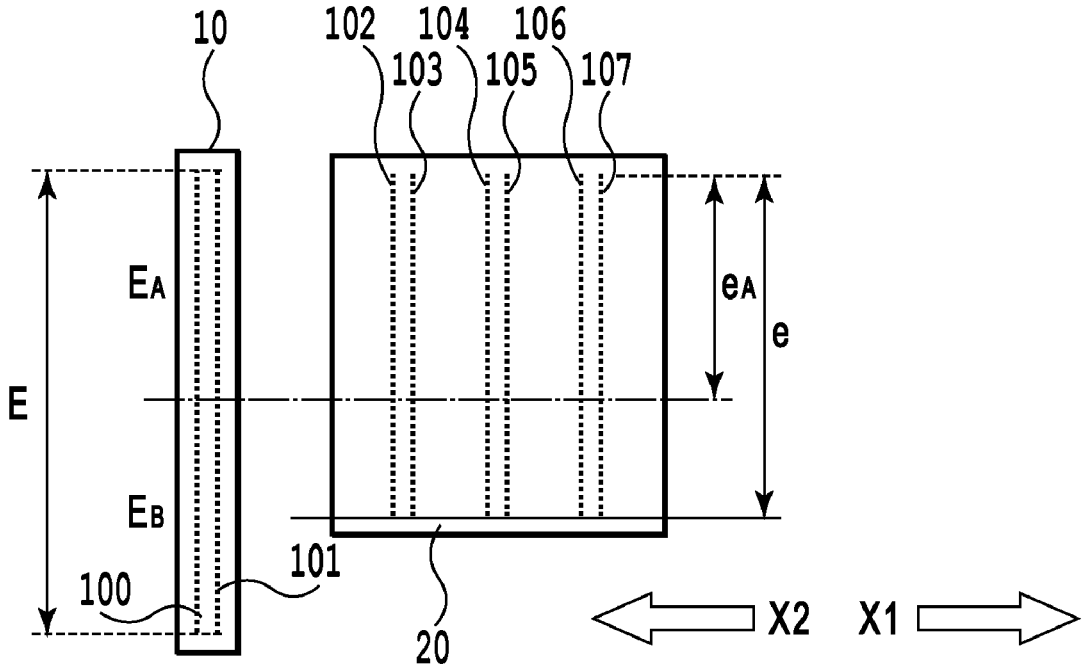
FIG. 6 is a schematic view of a black tip and a color tip according to a second embodiment of the present invention.

FIG. 6 is a schematic view of a black tip 10 and a color tip 20 according to the second embodiment. In the second embodiment, as same as the first embodiment, the width of usable maximum area (maximum eject port area) in the ink eject port arrays 100 and 101, which are formed in the black tip 10, is defined as "E". Also, the width of usable maximum area (maximum eject port area) in the ink eject port arrays 102 to 107, which are formed in the color tip 20, is defined as "e". According to the second embodiment, when carrying out bidirectional printing using black nozzles and color nozzles, the width of the color nozzles is used being limited to "eA". That is, in the same main scanning in the identical printing area of the printing medium, the maximum width of the eject port area capable of printing with the black tip 10 and the color tip 20 is "eA". Also, the relationship between "E" and "eA" is "E"="eA"×2.

Third Embodiment

In the printing head according to the first embodiment, the eject port array of the color ink is disposed at the upstream side of the black ink eject port array. The present invention is not limited to the above arrangement. That is, in the printing head, the color ink eject port array may be disposed at the downstream side of the black ink eject port array.

Figure 7:
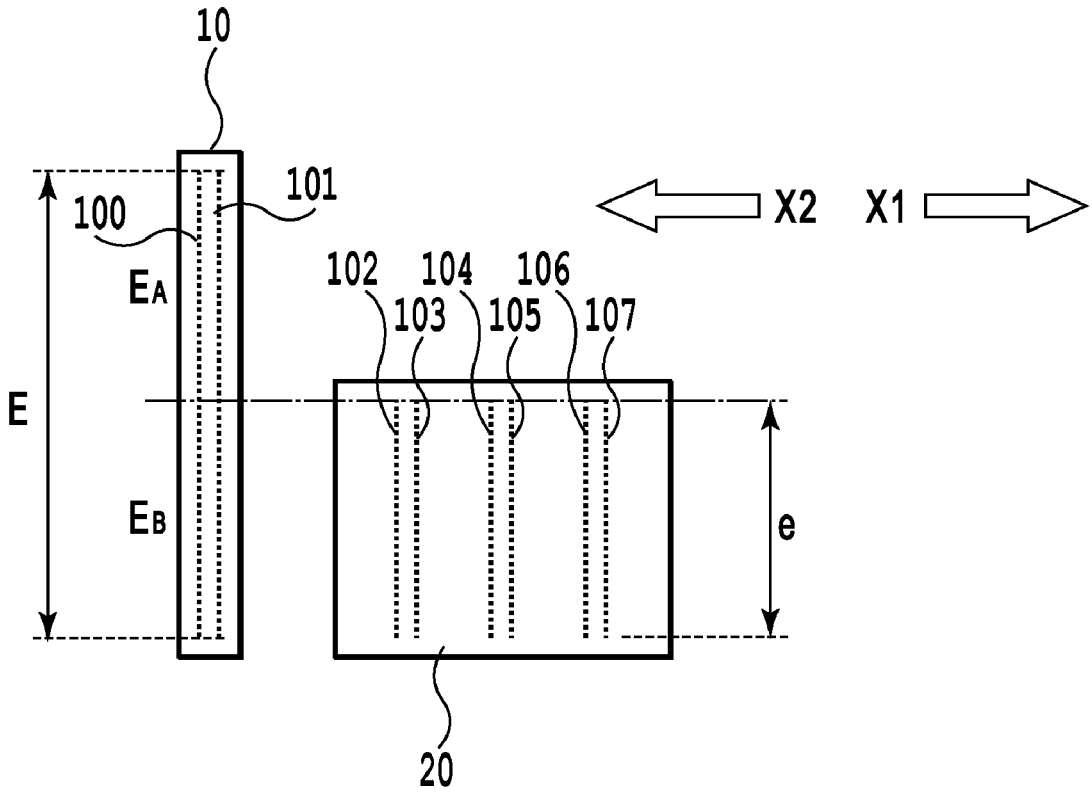
FIG. 7 is a schematic view of a black tip and a color tip according to a third embodiment of the present invention.
Figure 8:
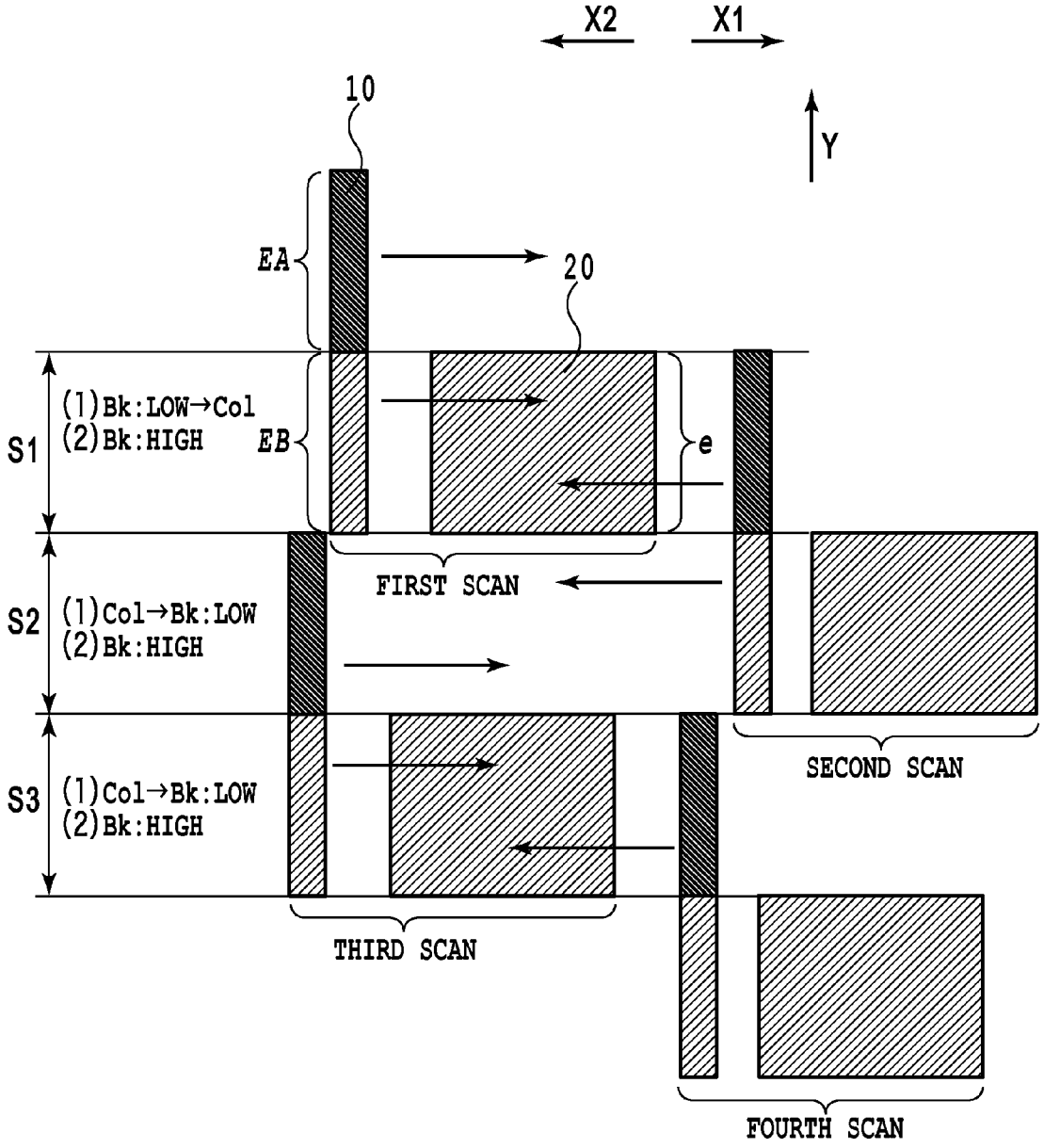
FIG. 8 illustrates printing operation according to the third embodiment of the present invention.

FIG. 7 is a schematic view of the black tip 10 and the color tip 20 according to the third embodiment. FIG. 8 illustrates the printing operation according to the embodiment. The printing operation is the same as that of the first embodiment. The printing ratio of the eject port area "EA" (second nozzle group) is larger than that of the eject port area "EB" (first nozzle group). Particularly, the printing ratio X of the second nozzle group according to the embodiment is preferably within a range of 50%<X<80%.

With this arrangement, the printing ratio using the black first nozzle group, which overlaps with the color eject port area "e", is reduced. Therefore, even when the bidirectional printing is carried out, the application amount of the black ink is small. Therefore, the occurrence of unevenness of color, which is caused by the difference of the printing order of the black ink and the color ink between the forward scan and the backward scan, is reduced.

In the above-described embodiments, the printing head with the eject port array of the color ink, which is arranged symmetrically in the main scanning direction, is used. The present invention is not limited to the above. That is, the plurality of eject port arrays each ejecting color ink may not be provided. Even when the eject port arrays are provided, the eject port arrays may not be arranged symmetrically. The printing head as described above, particularly when used for printing using black ink having a printing time difference, the unevenness of color caused by the symmetrically disposed color ink eject port arrays is hardly recognized visually, and thus the image degradation can be suppressed.

Fourth Embodiment

In the printing head according to a fourth embodiment, the color ink eject port arrays are disposed at the upstream side of the black ink eject port array as same as the first embodiment. According to the embodiment, in order to form the image satisfactorily on the printing medium, a pre-treatment liquid is applied onto the printing medium using a roller prior to the printing with the printing head. That is, a printing apparatus according to the embodiment is provided with an application means for applying a pre-treatment liquid containing a compound that insolubilizes the coloring agent contained in the printing liquid.

<Pre-treatment Liquid>

The pre-treatment liquid used in the present invention includes a reactive component that insolubilizes or aggregates the color material contained in the ink. For example, the pre-treatment liquid includes, in the hydraulic medium, ink including color material which is stably dispersed or dissolved due to an action of the ionic group and at least any one of reactive component selected from metallic salt (particularly, polymetal ion and salt thereof), low molecular cationic compound and cationic high molecular, which is capable of destroying the dispersion stability of the ink and aggregating the same when the same is brought into contact with ink on the printing medium. The reactive components will be described below.

(Polymetal Ion and Salt thereof)

To be more precisely, preferred polymetal ions usable for the pre-treatment liquid according to the present invention are; for example, divalent metallic ions of $Ca^{2+}$, $Cu^{2+}$, $Ni^{2+}$, $Mg^{2+}$, $Zn^{2+}$, $Sr^{2+}$, $Ba^{2+}$ and the like, or triad metal ions of $Al^{3+}$, $Fe^{3+}$, $Cr^{3+}$, $Y^{3+}$ and the like are available but not limited thereto. In order to cause the pre-treatment liquid to include the polymetal ions, poly metal salt is used. The salt is metallic salt composed of the above-listed polymetal ions and anion, which combines with these ions and dissolves into water. Preferred anions for composing salt, for example, $Cl^-$, $NO^{3-}$, $I^-$, $Br^-$, $ClO^{3-}$, $SO_4^{2-}$, $CO_3^{2-}$, $CH_3COO^-$, $HCOO^-$ and the like are available but not limited thereto.

According to the present invention, in view of reactivity, coloring performance and easy to handling, the polymetal ion of $Ca^{2+}$, $Mg^{2+}$, $Sr^{2+}$, $Al^{3+}$ or $Y^{3+}$ is particularly preferred. Further, $Ca^{2+}$ is preferred. As for the anion, in view of solubility, $NO^{3-}$ is particularly preferred.

Figure 9:
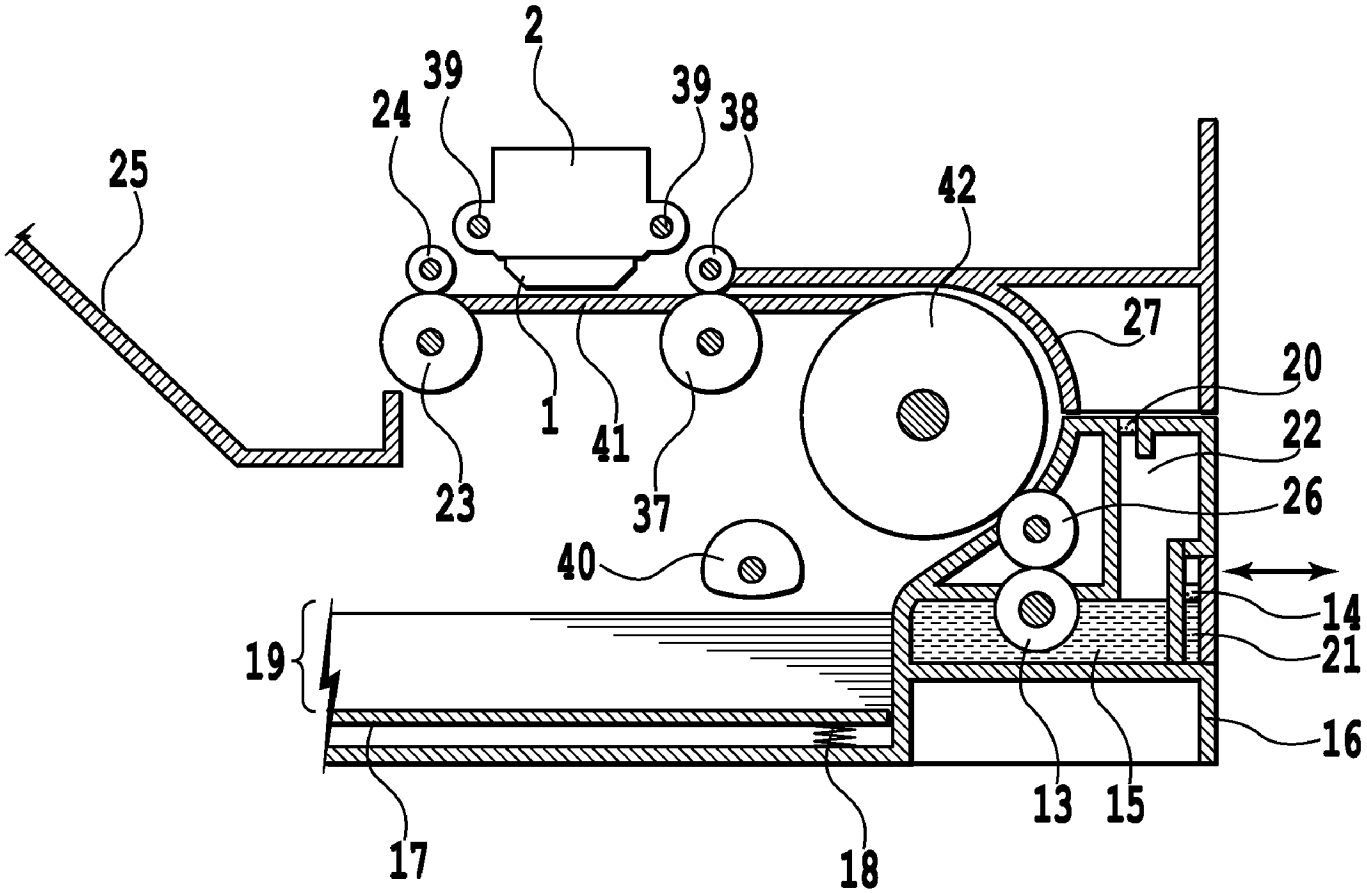
FIG. 9 is a schematic view illustrating an essential portion of an ink jet printing apparatus according to a fourth embodiment of the present invention.
Figures 10A, 10B:
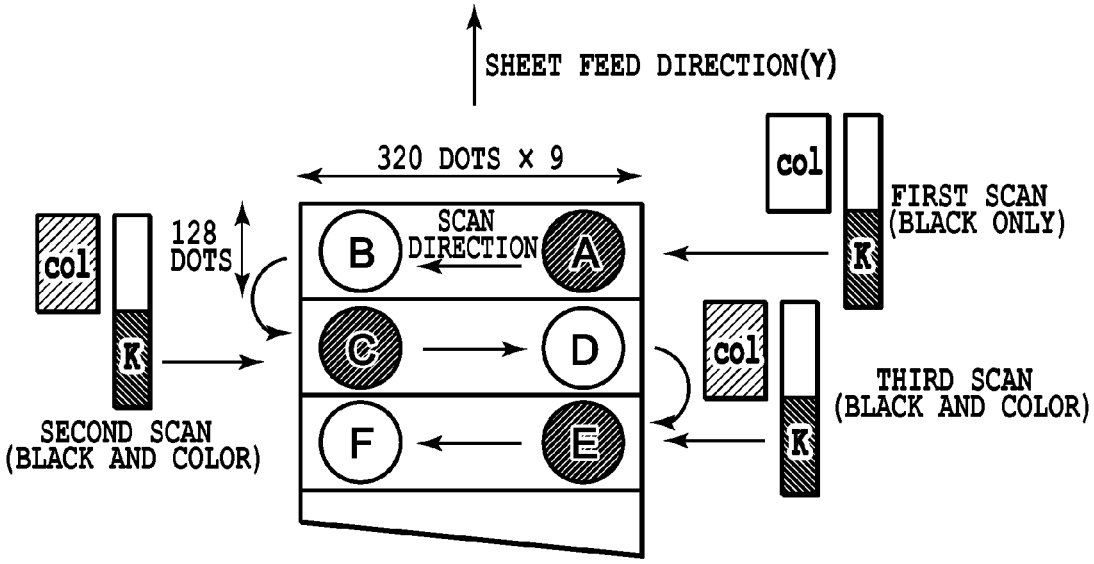
FIGS. 10A and 10B illustrate density difference, which occurs when the printing is carried out with a conventional bidirectional main scanning.

FIG. 9 illustrates an example of an ink jet printing apparatus according to the embodiment. An image forming apparatus of the ink jet printing apparatus employs a serial type ink jet printing system. The image forming apparatus includes a printing head 1, a sheet conveyer cassette 16, a drive unit that drives the printing head to reciprocate in a direction (main scanning direction) orthogonal to a conveying direction of a printing sheet (sub-scanning direction), and a control unit that controls to drive these components. The sheet conveyer cassette 16 includes a sheet convey tray 17 for conveying a printing medium (referred to as printing sheet) 19 and a unit for applying liquid composition of the present invention, which are integrally formed with each other.

The printing head 1 is mounted on the carriage 2 with its face, which is formed with an ink eject port, facing the platen 41 side. Although not illustrated in FIG. 9, the printing head 1 has the ink eject ports, a plurality of electrothermal converters (for example, heat generating resistance element) for heating the ink liquid and a substrate that supports the above. The printing head 1 includes an ink cartridge mounted within a carriage located thereabove.

The carriage 2 is mounted with the printing head 1 and is capable of reciprocating along two guide shafts 9 extending parallel to each other along a width direction of the printing sheet 19. The printing head 1 is driven synchronously with the reciprocation of the carriage, and ejects ink droplet onto the printing sheet 19 to form an image. The sheet conveyer cassette 16 is detachably mounted on the image forming apparatus main body. The printing sheets 19 are stacked and stored on the sheet convey tray 17 on the sheet conveyer cassette 16. When the printing sheets 19 are mounted, a spring 18 presses the sheet convey tray 17 upward and the uppermost sheet is contact-pressed onto a sheet convey roller 40. The sheet convey roller 10 is a roller having a cross section of a generally half-moon like shape. The sheet convey roller 10 is driven to rotate by a motor (not shown) to convey only the uppermost sheet (printing sheet 19) with a separator claw (not shown).

The separated and fed printing sheet 19 is fed by an intermediate roller 42 having a large diameter and press-contacting thereto, an application roller 26 having a small diameter along a conveying surface of the sheet conveyer cassette 16 and a conveying surface of a paper guide 27. Each of the conveying surfaces has a surface curved to form an arc concentric with the intermediate roller 42. Therefore, the conveying direction of the printing sheet 19 is inversed while passing through these conveying surfaces. That is, the surface to be printed of the printing sheet 19 is faced downward when the same is fed out from the sheet convey tray 17 until the same reaches the intermediate roller 42. However, at a point where the printing sheet 19 is opposed to the printing head 1, the same is faced upward (printing head 1 side). Therefore, the printed surface of the printing sheet is always faced to the outward direction of the image forming apparatus.

A liquid composition application unit is provided within the sheet conveyer cassette 16. The liquid composition application unit includes a replenishment tank 22, the intermediate roller 42 and the application roller 26. The replenishment tank 22 is used for supplying liquid composition 15. The intermediate roller 42 is rotatably supported in a state that a part of the periphery surface of the tank 22 is soaked in the liquid composition 15. The application roller 26 is disposed parallel with the intermediate roller 42 in contact with the intermediate roller 42 and rotated in the same direction thereof. The application roller 26 is disposed parallel with the intermediate roller 42 for conveying the printing sheet 19 in contact therewith. Therefore, when the printing sheet 19 is fed, the application roller 26 is rotated along with the intermediate roller 42. As a result, the liquid composition 15 is supplied on the periphery surface of the application roller 26 by a supply roller 13. Further, the liquid composition is uniformly applied on the printed surface of the printing sheet 19, which is nipped by the application roller 26 and the intermediate roller 42 therebetween, by the supply roller 13.

The image forming apparatus is provided with a float 14 within a replenishment tank 22. The float 14 is composed of a matter having a specific gravity smaller than that of the liquid composition 15. With the float 14 floating on the liquid surface of the liquid composition, the remaining amount of the liquid composition including reaction component can be visually checked through a remain-level indicator 21 made of a transparent member.

Replenishment method of the liquid composition is as follows. In a state that the sheet conveyer cassette 16 is pulled out from the image forming apparatus main body, the replenishment tank 22 can be replenished with the liquid composition using a filler inserted into refill port 20 made of a rubber material through the front end thereof.

After being applied with the liquid composition, the printing sheet is fed by a predetermined distance up to the printing section by a main conveying roller 37 and a pinch roller 38 being in closely contact therewith. Then, the printing sheet is applied with the ink from the printing head 1. With the arrangement as described above, the printed printing sheet 19 is fed and ejected, and stacked onto an eject tray 25 by an eject roller 23 and a drive roller 24 being in close contact therewith.

When the liquid composition is applied using a roller or the like, since small amount of the liquid composition can effectively reduce the stability of ink and the print can be fixed stably, it is preferred that the liquid composition is prepared so that the viscosity thereof is higher than that of the ink. To be more specifically, in the liquid composition with higher viscosity, since the polymetal ions tend to stay in an upper area of the printing medium, the polymetal ions can effectively react with the ink.

In this embodiment, the printing ratio in the eject port area "EB", which is not parallel with the eject port area "e" of the color ink, is controlled to be $50\%<X<80\%$ as same as the first embodiment. As a result, the printing ratio using the black eject port area "EA", which overlaps with the color eject port area "e", is reduced. Therefore, even when the bidirectional printing is carried out, the amount of the black ink ejected by the eject port area "EB" is reduced. Therefore, the problem of unevenness of color, which is caused from the difference of the printing order of the black ink and the color ink in the forward scan and the backward scan, is reduced. That is, after the printing is carried out by the eject port area "EB", even in the area printed by the eject port area "e" including a small time difference, the color ink is ejected after the black ink has permeated into the printing medium. Further, in an area where the eject port area "e" of the color ink and the eject port area "EA" of the black ink are disposed parallel, the pre-treatment liquid reacts with the black ink. Therefore, when the printing ratio is $20\%<X<50\%$, little unevenness of color occurs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-245368, filed Sep. 21, 2007, which is hereby incorporated by reference herein in its entirety.

What is claimed is:

1. An ink jet printing apparatus comprising:

a printing head; and a print unit configured to scan the printing head in a forward direction and a backward direction, which is opposite to the forward direction and crosses a conveying direction of a printing medium to perform printing, wherein the printing head includes a first eject port array having a plurality of eject ports for ejecting black ink, arranged in the conveying direction of the printing medium, and a second eject port array having a plurality of eject ports for ejecting color ink, arranged in the conveying direction of the printing medium and being shorter than the first eject port array in the conveying direction of the printing medium, wherein the first eject port array has a first eject port group and a second eject port group, wherein the first eject port group is disposed in a same position as the second eject port array in the conveying direction, wherein the second eject port group is disposed in a displaced position from the second eject port array in the conveying direction, wherein the printing unit causes the printing head to eject the black ink and the color ink in both forward and backward directions, wherein in an identical printing area of the printing medium, a printing ratio of the first eject port group is lower than that of the second eject port group, and wherein the color ink contains a component that reduces dispersion stability of the black ink.

2. The ink jet printing apparatus according to claim 1, wherein second eject port array is a plurality of eject port arrays for ejecting multiple color inks, eject port arrays of identical ink in the plurality of eject port arrays are arranged symmetrically, with respect to a scanning direction of the printing head.

3. The ink jet printing apparatus according to claim 1, wherein a printing ratio X of second eject port group is $50\%<X<80\%$.

4. The ink jet printing apparatus according to claim 1, wherein the printing unit controls the printing head so that the second eject port group and the first eject port group scan a predetermined area of the printing medium in this order for printing.

5. An ink jet printing apparatus comprising:

a printing head; and a print unit configured to scan the printing head in a forward direction and a backward direction, which is opposite to the forward direction and crosses a conveying direction of a printing medium to perform printing, wherein the printing head includes a first eject port array having a plurality of eject ports for ejecting black ink, arranged in the conveying direction of the printing medium, and a second eject port array having a plurality of eject ports for ejecting color ink, arranged in the conveying direction of the printing medium and being shorter than the first eject port array in the conveying direction of the printing medium, wherein the first eject port array has a first eject port group and a second eject port group, wherein the first eject port group is disposed in a same position as the second eject port array in the conveying direction, wherein the second eject port group is disposed in a displaced position from the second eject port array in the conveying direction, wherein the printing unit causes the printing head to eject the black ink and the color ink in both forward and backward directions, wherein in an identical printing area of the printing medium, a printing ratio of the first eject port group is lower than that of the second eject port group, and wherein the printing medium contains a component that reduces dispersion stability of the black ink.

6. An ink jet printing apparatus comprising:

a printing head; and a print unit configured to scan the printing head in a forward direction and a backward direction, which is opposite to the forward direction and crosses a conveying direction of a printing medium to perform printing, wherein the printing head includes a first eject port array having a plurality of eject ports for ejecting black ink, arranged in the conveying direction of the printing medium, and a second eject port array having a plurality of eject ports for ejecting color ink, arranged in the conveying direction of the printing medium and being shorter than the first eject port array in the conveying direction of the printing medium, wherein the first eject port array has a first eject port group and a second eject port group, wherein the first eject port group is disposed in a same position as the second eject port array in the conveying direction, wherein the second eject port group is disposed in a displaced position from the second eject port array in the conveying direction, wherein the printing unit causes the printing head to eject the black ink and the color ink in both forward and backward directions, wherein in an identical printing area of the printing medium, a printing ratio of the first eject port group is lower than that of the second eject port group, and wherein the ink jet printing apparatus includes an application means that applies pre-treatment liquid to a printing area of the printing medium, the pre-treatment liquid containing a compound for insolubilizing a coloring agent in a printing liquid.

7. An ink jet printing method for printing an image on a printing medium, the method comprising the step of:

scanning a printing head in a forward direction and a backward direction, which is opposite to the forward direction and crosses a conveying direction of the printing medium to perform printing, wherein the printing head includes a first eject port array having a plurality of eject ports for ejecting black ink, arranged in the conveying direction of the printing medium, and a second eject port array having a plurality of eject ports for ejecting color ink, arranged in the conveying direction of the printing medium and being shorter than the first eject port array in the conveying direction of the printing medium, wherein the first eject port array has a first eject port group and a second eject port group, wherein the first eject port group is disposed in a same position as the second eject port array in the conveying direction, wherein the second eject port group is disposed in a displaced position from the second eject port array in the conveying direction, wherein the printing head ejects the black ink and the color ink in both forward and backward directions, wherein the first eject port group prints an identical area of the printing medium with the same scan as the second eject port array, wherein the second eject port group does not print the identical area of the printing medium with the same scan as the second eject port array, wherein in the identical printing area of the printing medium, a printing ratio of the first eject port group is lower than that of the second eject port group, and wherein the color ink contains a component that reduces dispersion stability of the black ink.

8. The ink jet printing method according to claim 7, wherein a printing ratio X of the second eject port group is $50\% < X < 80\%$.

9. An ink jet printing method for printing an image on a printing medium, the method comprising the step of:

scanning a printing head in a forward direction and a backward direction, which is opposite to the forward direction and crosses a conveying direction of the printing medium to perform printing, wherein the printing head includes a first eject port array having a plurality of eject ports for ejecting black ink, arranged in the conveying direction of the printing medium, and a second eject port array having a plurality of eject ports for ejecting color ink, arranged in the conveying direction of the printing medium and being shorter than the first eject port array in the conveying direction of the printing medium, wherein the first eject port array has a first eject port group and a second eject port group, wherein the first eject port group is disposed in a same position as the second eject port array in the conveying direction, wherein the second eject port group is disposed in a displaced position from the second eject port array in the conveying direction, wherein the printing head ejects the black ink and the color ink in both forward and backward directions, wherein the first eject port group prints an identical area of the printing medium with the same scan as the second eject port array, wherein the second eject port group does not print the identical area of the printing medium with the same scan as the second eject port array, wherein in the identical printing area of the printing medium, a printing ratio of the first eject port group is lower than that of the second eject port group, and wherein the printing medium contains a component that reduces dispersion stability of the black ink.

10. An ink jet printing method for printing an image on a printing medium, the method comprising the steps of:

applying pre-treatment liquid to a printing area of the printing medium, the pre-treatment liquid containing a compound for insolubilizing a coloring agent in a printing liquid; and scanning a printing head in a forward direction and a backward direction, which is opposite to the forward direction and crosses a conveying direction of the printing medium to perform printing, wherein the printing head includes a first eject port array having a plurality of eject ports for ejecting black ink, arranged in the conveying direction of the printing medium, and a second eject port array having a plurality of eject ports for ejecting color ink, arranged in the conveying direction of the printing medium and being shorter than the first eject port array in the conveying direction of the printing medium, wherein the first eject port array has a first eject port group and a second eject port group, wherein the first eject port group is disposed in a same position as the second eject port array in the conveying direction, wherein the second eject port group is disposed in a displaced position from the second eject port array in the conveying direction, wherein the printing head ejects the black ink and the color ink in both forward and backward directions, wherein the first eject port group prints an identical area of the printing medium with the same scan as the second eject port array, wherein the second eject port group does not print the identical area of the printing medium with the same scan as the second eject port array, wherein in the identical printing area of the printing medium, a printing ratio of the first eject port group is lower than that of the second eject port group.

* * * * *